United States Patent [19]

Knowlton

[11] 4,202,673

[45] May 13, 1980

[54] COAL CONVERSION APPARATUS

[75] Inventor: Ted M. Knowlton, Hinsdale, Ill.

[73] Assignee: Gas Research Institute, Chicago, Ill.

[21] Appl. No.: 934,515

[22] Filed: Aug. 17, 1978

Related U.S. Application Data

[63] Continuation-in-part of Ser. No. 799,196, May 23, 1977, abandoned.

[51] Int. Cl.[2] ..... C10J 3/50; B65G 53/42

[52] U.S. Cl. ..... 48/86 R; 406/93; 406/108

[58] Field of Search ..... 302/17, 24, 29, 41, 302/47, 51, 48, 64, 25; 291/7, 11 R; 48/77, 86 R, 86 A, DIG. 4; 406/93–95, 108

[56] References Cited

U.S. PATENT DOCUMENTS

| | | | |
|---|---|---|---|
| 1,086,964 | 2/1914 | White . | |
| 2,554,263 | 5/1951 | Nelson | 48/DIG. 4 |
| 2,595,255 | 5/1952 | Holder | 48/DIG. 4 |
| 2,609,249 | 9/1952 | Winter, Jr. . | |
| 2,684,869 | 7/1954 | Lapple . | |
| 2,723,883 | 11/1955 | Lapple | 302/17 |
| 3,239,278 | 3/1966 | Mueller et al. | 302/51 |
| 3,874,739 | 4/1975 | Mitchell . | |
| 4,002,372 | 1/1977 | Edwards et al. | 302/25 |

*Primary Examiner*—Jeffrey V. Nase

*Attorney, Agent, or Firm*—Allegretti, Newitt, Witcoff & McAndrews

[57] ABSTRACT

An improved valve apparatus for the introduction of finely divided coal solids into a vessel in a controlled manner is disclosed. The disclosed apparatus includes substantially vertical and horizontal conduits interconnected to provide a generally continuous L-shaped flow path therethrough. Gas is introduced directly into the bottom portion of the vertical conduit upstream from the point where the vertical conduit and horizontal conduit interconnect. The flow rate of the gas introduced into the vertical conduit is controlled to adjust the amount of coal solids discharged from the discharge end of the horizontal conduit.

4 Claims, 2 Drawing Figures

COAL CONVERSION APPARATUS

RELATED APPLICATION

This application is a continuation-in-part of copending application Ser. No. 799,196, filed May 23, 1977, now abandoned.

BACKGROUND OF THE INVENTION

This invention relates to an apparatus for the introduction of finely divided coal solids into a vessel in a carefully controlled reliable manner.

Particulate solids material, particularly finely divided particulate solids must be frequently handled in chemical processes. For example, in coal conversion, the art is replete with examples for the conversion of finely divided coal material into a more valuable gaseous product. Traditionally, particulate solids, such as coal solids, are transferred or discharged from a storage or reaction vessel to a vertical tube called a standpipe. The solids flow rate through the standpipe is generally controlled by a slide valve, cone valve, trickle valve, screw feeder or other similar mechanical device positioned at the bottom of the standpipe. A problem commonly associated with these mechanical devices is their propensity to plug when the solid materials, i.e. coal, contained therein are exposed to moderate or high temperatures and pressures. In addition, these mechanical valve devices, when installed in an overall process, are inevitably placed in relatively inaccessible locations. Accordingly, when these mechanical devices plug, as they frequently do, they are difficult to unplug or repair because of their inaccessability. In addition, particulate solids are generally very abrasive. As a result, mechanical devices requiring movement between valve components must utilize expensive material for construction so that the mechanical valve does not become rapidly corroded.

The problems associated with mechanical errosion and valve plugging are particularly vexatious when such valves are utilized in conjunction with the high temperatures and pressures utilized in modern processes for the gasification of coal. For example, most coal has a substantial tendency to agglomerate or stick when exposed to high temperatures. As a result, coal, which has been substantially reduced in size, when exposed to high temperatures, agglomerates and becomes sticky when exposed to high temperatures. The advantages of the original comminution step used pulverizing the coal have been diminished and, just as importantly, the coal has a tendency to agglomerate or stick to the apparatus per se. In an effort to remove some of these agglomeration problems, the art has attempted to introduce the coal into the reaction bed at a point far removed from the high temperature associated with the coal gasification reaction. For example, the prior art traditionally introduces the finely divided particulate coal into the free space that is present above the fluidized bed contained in the lower portion of the reactor. This method of introduction results in diminished conversion of coal to gas products because the upward velocity of the gas emitted from the fluid gasification bed generally sweeps with it fine particles in the feed material. As a result, these fine coal particles are carried out of the reaction zone and are not converted therein to gaseous products. Although these fines can be recovered in downstream processing equipment and then returned to the reaction zone, this is not an efficient method of conversion since it increases the cost of downstream processing equipment.

Because of these problems associated with mechanical valve arrangements, the prior art has endeavored to develop improved methods of transferring solid materials in a controlled manner. For example, in Lapple, U.S. Pat. No. 2,684,869, there is described an apparatus for handling pulverulent material which comprises a vertical pipe connected to a horizontal pipe section via a standard pipe tee. According to the teachings of Lapple, gas is introduced into the bottom portion of the tee at a point which represents a discontinuity in the flow path of the solids through the apparatus. Because of the general geometry and discontinuities associated with the Lapple apparatus, high flow rates are not attainable through the Lapple apparatus. In fact, the dead spaces contained in the Lapple apparatus and adjacent in the introduction point for the gas utilized to transport the pulverulent material, when used in a coal gasification environment, can cause coal to accumulate and agglomerate therein, thus leading to unreliable control over the solids flowing through the apparatus. In addition, the Lapple apparatus requires the introduction of appreciable gas volumes to produce the desired flow rate through the apparatus.

Several "valves" are illustrated in *Perry's Chemical Engineers Handbook,* Fourth Edition, pages 20–47 through 20–49. For example, *Perry* illustrated an ICI valve which is described as serving better as a seal device than a solids control valve. As illustrated, the ICI "valve" comprises a generally vertical column. As a result, this ICI structure contains a dead spot or discontinuity in the bottom portion thereof which will interfere with efficient solids flow therethrough and, more particularly, in the case of coal processing, will produce a situs for inadvertent undesired coal agglomeration. It is clear that this ICI valve cannot reliably and efficiently and accurately control solids particularly in view of *Perry's* characterization of the valve as a seal device rather than a control valve.

SUMMARY OF THE INVENTION

It is an object of the present invention to provide an apparatus for the reliable introduction of finely divided solids, particularly coal, into a vessel in a carefully controlled manner.

It is a particular object of the present invention to provide a method and apparatus for controlling the rate at which finely divided particulate coal is introduced directly into a high temperature fluidized bed coal gasification reactor without agglomeration of the coal in the apparatus which may lead to plugging thereof.

It is a specific object of the present invention to provide apparatus which will permit finely divided particulate coal to be introduced directly into a fluidized reaction bed so that all of the coal so introduced is efficiently converted to a gaseous product.

According to the present invention, these objects are satisfied in an apparatus for the conversion of finely divided coal particles into a gaseous product through the utilization of a substantially vertical conduit adapted to receive the finely divided coal particles in the upper end thereof. The vertical conduit is positioned in communication with a horizontal conduit, preferably through the use of an elbow, to provide a continuous L-shaped flow path through the horizontal and vertical conduits and into the bottom fluidized bed of the conversion reactor. In other words, the conduits are characterized by the absence of discontinuities in the flow path therethrough. The vertical and horizontal conduits are further characterized as having dimensions, i.e. length and/or diameter, sufficient to prevent solids which enter the upper portion of the vertical conduit from flowing or passing from the bottom portion thereof into the horizontal conduit in the absence of the introduction of a gas stream directly into the bottom end of the vertical conduit at a point above the bottom end of the vertical conduit and upstream from the point where the vertical conduit communicates with the horizontal conduit. The flow rate of the gas stream into the bottom end of the vertical conduit is controlled and means is also provided to introduce gas directly into the top of the horizontal conduit to minimize agglomeration of the coal particles and at a predetermined distance upstream from the discharge end of the horizontal conduit, but downstream from the bottom end of the vertical conduit.

The apparatus of the present invention is particularly useful for controlling the rate at which finely divided particulate coal is introduced into a fluidized bed coal gasification reactor and is particularly useful for the introduction of finely divided coal directly into a high temperature fluidized bed of coal contained in a fluid bed, coal gasification reactor. According to this aspect of the invention, finely divided coal is introduced into a substantially vertical conduit, communicating with a horizontal conduit, at the top portion thereof. A gas stream is then introduced into the bottom portion of the vertical conduit. This gas introduction permits the coal to flow through the generally continuous L-shaped flow path so that the coal can then be discharged directly into the fluidized coal bed. The rate of gas stream introduced into the vertical conduit adjusts or controls, in a predetermined fashion, the rate of coal addition to the fluizied bed reactor. In the absence of this gas introduction, the vertical and horizontal conduits are sized such that the coal will not flow into the fluid bed. A second gas stream is also preferably introduced into the top of the horizontal conduit at a point between its discharge end and the bottom end of the vertical conduit to promote coal flow through the horizontal conduit and to minimize agglomeration therein. This embodiment further permits any coal contained in the horizontal conduit to be removed or purged therefrom by maintaining the flow of the second gas stream and terminating the introduction of gas flow to the vertical conduit. As a result, the coal is removed from the horizontal conduit and agglomeration of particulate solids therein is avoided.

The point at which gaseous material is added to the vertical conduit of the L-shaped valve of the present invention is a function of the length and diameter of the pipe as well as the nature of the solids being transmitted therethrough. As a result, it is very difficult to specify actual numerical values associated therewith. The tap location, however, can be readily determined for a given pipe and material by routine, simple experimentation according to the teachings of the present invention.

Other objects and embodiments will be developed in the following more detailed description of the process of the present invention.

DETAILED DESCRIPTION OF THE INVENTION

Figure 1:
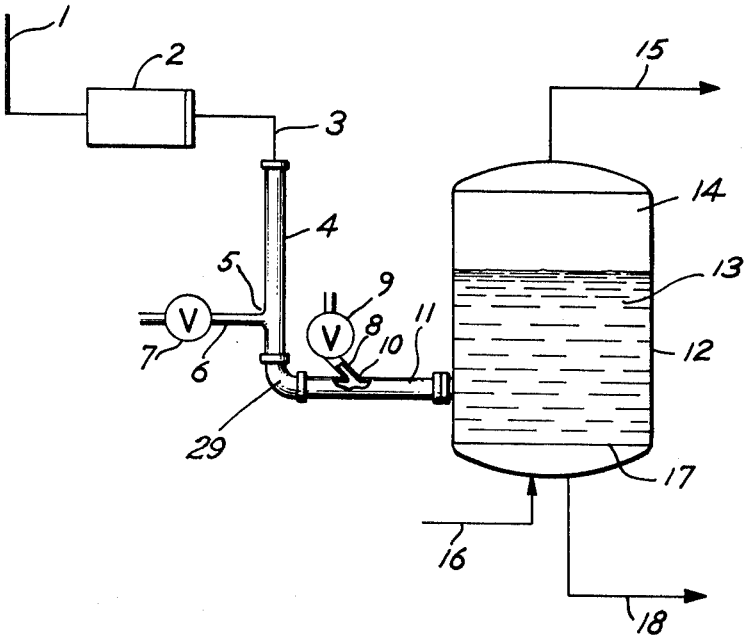
FIG. 1 illustrates, partially schematically, the introduction of finely divided coal material directly into a fluidized bed gasification reactor.

Referring to FIG. 1, there is illustrated a preferred embodiment of the present invention for the introduction of finely divided particulate coal directly into the fluid bed of a fluid bed gasification zone 12 wherein the coal introduced through a conduit 1 is comminuted by conventional means to a particulate size of about 230 mesh to ¼ inch and preferably to a size of about 100 mesh to 8 mesh in pulverizer 2. The resultant comminuted coal is then passed via line 3 to vertical conduit 4 of the L-shaped feeder valve prior to introduction of the coal to fluidized bed reactor 12. Vertical conduit 4 is connected to and communicates with horizontal conduit 11 via elbow 29 to provide a generally L-shaped valve for introducing the comminuted coal to reactor 12. The solids in vertical conduit 4 pack above elbow 29 and assume their particular angle of repose in the horizontal conduit section 11 of the L-shaped feeder device. Solids flow through the L-shaped feeder device is initiated by providing a predetermined threshold amount of aeration gas such as air, oxygen or steam which enters opening 5 of vertical conduit 4 through conduit 6 at a point above the bottom end of the vertical conduit and upstream of elbow 29. The amount of gas is controlled by the adjustment of valve 7. The resistance of solid flow through horizontal conduit 11 is overcome as the amount of gas entering via opening 5 of vertical conduit 4 is increased. As a consequence, the finely divided coal flows freely into the fluidized bed 13 of solids contained in reaction zone 12. The rate of solids flow is carefully adjusted by increasing or decreasing the amount of gas fed to the L-shaped feeder valve. The maximum amount of solids flow through the valve is the maximum rate at which the vertical conduit 4 can be fed from pulverizer 2.

A particular advantageous feature of the apparatus of the present invention is that it permits the use of finely divided particulate coal having a wide size range. For example, the presence of very fine material, in the particulate coal does not present any substantial operational difficulties. As a result, the fines can be introduced directly into the fluidized bed of the reactor below the top thereof and preferably when the bottom of the fluidized bed wherein the fines can be converted and are not lost with the product removed from the system.

Additional gas is introduced into the top of horizontal conduit 11 from line 8 via top opening 10 as shown in FIG. 1. The flow rate of the gas entering conduit 11 is controlled by proper adjustment of valve 9. In any event, the gas stream introduced into horizontal leg 11 provides at least two operating advantages. First, this gas stream further dilutes the solids being transmitted with conduit 11 to further prevent the agglomeration of these coal particles therein. This gas introduction, however, does not interfere with the control offered by the gas introduction into vertical leg 4 via opening 5. Secondly, when the gas flow to the reactor is terminated to vertical leg 4, the continued introduction of gas via line 10 to horizontal conduit 11 permits removal of substantially all of the particulate material contained therein. As a result, little if any coal particles remain in horizontal conduit 11 when the flow of gas to opening 5 of conduit 4 is terminated so that potential agglomeration problems are eliminated. Opening 10 is located at the top only of horizontal conduit 11 to minimize the possibility of agglomeration in the opening of any coal particles which may remain in horizontal conduit 11 or which may be trapped in the opening 10. Opening 10 is also preferably located upstream of the discharge end of the horizontal conduit 11 into the fluidized bed 13 to avoid agglomeration in opening 10 due to back up from the bed. Opening 10 is also located somewhat downstream of the bottom end of the vertical conduit 4 and elbow 29 so that it is out of the coal particles which are at rest in the vertical conduit 4 during shutdown which might otherwise result in agglomeration and plugging of the opening 10.

Fluidized reaction zone 12 is a conventional reactor system designed for the conversion of coal to valuable gaseous products. Reactor 12 contains therein a fluid bed 13 of finely divided coal particles which are maintained above a grid 17 in a general fluid state by the upward introduction of steam and/or air via line 16. Unreacted coal, ash and agglomerates are removed from the bottom of the reactor for heat recovery and/or discharge via line 18. During the course of the reaction of the coal within reaction zone 12, normally gaseous products such as hydrogen, CO, methane, etc. are formed and are removed from the upper portion of reaction zone 12 via line 15. The valuable gaseous products are then recovered by means well-known to those skilled in the art.

Figure 2:
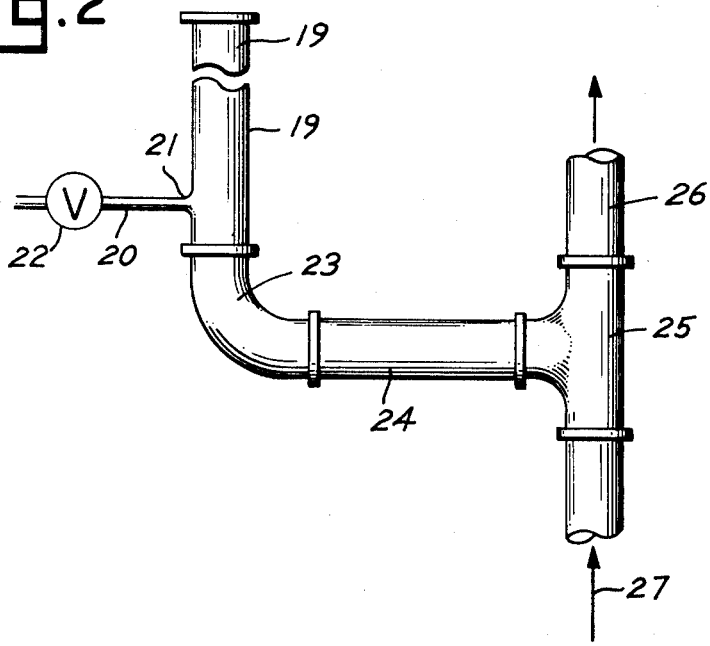
FIG. 2 illustrates, partially schematically, an embodiment of the present invention for the introduction of finely divided particulate material into a vessel or conduit containing a carrier gas flowing therethrough.

Illustrated in FIG. 2 is another embodiment of the present invention for introducing finely divided particulate solids into a pneumatic conveying line or vessel 26. According to this embodiment, the present invention comprises a generally vertical conduit 19 having contained in the bottom portion thereof an opening or tap 21 adapted to receive conduit 20 which, in turn, is controlled by valve 22. A suitable gaseous stream is introduced via opening or tap 21 by adjusting valve 22 to control the amount of solids passing downwardly through conduit 19. Conduit 19, in turn, is connected to horizontal conduit 24 via elbow 23. The length and diameter of conduit 19 is such that the particulate solids contained therein do not flow through conduit 24 without assistance from or the introduction of gas through opening 21. The introduction of gas by opening 21 overcomes the friction associated with the angle of repose of the solids contained in conduit 24 and permits the solid material to flow into pipe tee 25 wherein the solids are further entrained in a gas stream 27 flowing upwardly through conduit 26. The amount of aeration gas added through opening 21 solely determines the rate at which solids are added to the gas stream 27 flowing through conduit 26.

As in the case of the embodiment illustrated in FIG. 1, an opening (not shown) can be provided in the top of horizontal conduit 24 to permit the introduction of additional gas therein to prevent solid agglomeration within the conduit. The positioning of this additional gas introduction opening is preferably as described for the opening 10 shown in FIG. 1.

EXAMPLES

EXAMPLE I

An L-shaped valve apparatus according to the present invention was constructed from a one inch ID vertical pipe 20 feet in height connected to another one inch ID horizontal pipe 23 inches in length by a conventional elbow. The horizontal section of pipe was attached to an 11.5 inch ID fluidized bed maintained in a fluidized state by passing air through sand of a −20 to a +40 mesh particle size range. An aeration tap was located in the vertical standpipe section of the device at a point twelve inches above the center line of the downstream horizontal pipe section. Sand of −20 to +40 mesh particle size was fed continuously to the vertical standpipe from a storage hopper. Air was passed to the aeration tap of the standpipe through a rotameter controlled valve arrangement. This rotameter controlled valve arrangement was the sole method used to control the rate of solids flow through the L-shaped valve into the downstream fluidized bed.

Utilizing this apparatus, the following results were obtained.

| Aeration Gas Rate CMF 70° F. 14.7 PSI | Solids Flow Rate Fed to Fluidized Bed, Lbs. Per Hr. |
|---|---|
| 0 | 0 |
| 0.45 | 160 |
| 0.60 | 540 |
| 0.75 | 1,000 |
| 0.90 | 1,640 |
| 0.95 | 2,020 |
| 1.00 | 2,600 |

This data clearly shows that a small amount of aeration gas can transfer large amounts of solids to an adjacent fluidized bed. Surprisingly, it was discovered that a higher solids flow rate can be achieved when the sand was passed into a fluid bed than resulted when the sand was passed into an open receiver at the same aeration gas rates.

EXAMPLE II

The apparatus of the present invention was compared to the apparatus illustrated in Lapple, U.S. Pat. No. 2,684,869. An apparatus was constructed according to the teachings of Lapple by connecting a standard pipe tee to the end of a one inch ID solid standpipe. Aeration gas was added to one end of the pipe tee and solids were discharged from the other end into a horizontal transfer pipe. The valve described in Example I was then compared through a series of comparative experiments to this prior art Lapple apparatus. In the comparative studies, the amount of aeration, i.e. air rate, required to transport the −20 to +40 mesh sand from a one inch diameter standpipe was determined. The results are presented below.

Table II

| Solids Flow Rate Through Device, Lbs./Hr. | Aeration Req'd by Lapple Device, CFM (20° C. 1 atm) | Aeration Req'd by L-Valve Feeder, CFM (20° C. 1 atm) |
|---|---|---|
| 0 | 0.00 | 0.00 |
| 126 | 0.60 | 0.54 |
| 300 | 0.75 | 0.65 |
| 558 | 0.90 | 0.75 |
| 768 | 1.00 | 0.83 |
| 1008 | 1.10 | 0.90 |
| 1584 | 1.25 (max. flow) | 1.03 |

Table II-continued

| Solids Flow Rate Through Device, Lbs./Hr. | Aeration Req'd by Lapple Device, CFM (20° C. 1 atm) | Aeration Req'd by L-Valve Feeder, CFM (20° C. 1 atm) |
|---|---|---|
| 1850 | | 1.14 |
| 2200 | | 1.19 |

As indicated in Table II, the maximum flow rate achieved through the Lapple apparatus was 1584 pounds per hour. This is substantially less than the 2200 pounds per hour which can be achieved through the use of the apparatus of the present invention.

EXAMPLE III

An L-shaped valve apparatus according to the present invention was constructed from a 4 inch nominal vertical pipe 28 feet in height connected to 3 inch nominal horizontal pipe 24 inches in length by a conventional elbow. The horizontal section of pipe was discharged to atmosphere. An aeration tap was located in the vertical standpipe section of the device at a point twelve inches above the center line of the downstream horizontal pipe section. Western Kentucky bituminous coal of ½ inch by 0 particle size was fed continuously to the vertical standpipe from a storage hopper. Air was passed to the aeration tap of the standpipe through a rotameter controlled valve arrangement. This rotameter controlled valve arrangement was the sole method used to control the rate of solids flow through the L-shaped valve.

Utilizing this apparatus, the following results were obtained.

| Aeration Gas Rate CFM 70° F. 14.7 PSI | Solids Flow Rate Through L-Valve, Lbs. Per Hr. |
|---|---|
| 0 | 0 |
| 10 | 3100 |
| 15 | 5000 |
| 19 | 6500 |
| 22 | 7800 |
| 27 | 9500 |

This data clearly shows that a small amount of aeration gas can transfer large amounts of large coal solids.

It will be understood that the embodiments of the present invention which have been described are merely illustrative of a few of the applications of the principles of the invention. Numerous modifications may be made by those skilled in the art without departing from the true spirit and scope of the invention.

What is claimed is:

1. An apparatus for the conversion of finely divided solid coal particles into gaseous products which comprise, in combination:

(i) a fluidized bed coal gasification reactor adapted to maintain a fluidized bed of coal particles in the bottom portion thereof;

(ii) a substantially vertical conduit having an upper end and a bottom end, said conduit adapted to receive said finely divided solid coal particles in the upper end thereof;

(iii) a substantially horizontal conduit, one end thereof communicating with the bottom end of said vertical conduit and the other end thereof adapted to discharge said coal particles from the horizontal conduit into the bottom fluidized bed portion of the reactor;

(iv) said communicating vertical and horizontal conduits positioned to provide a generally continuous, unrestricted L-shaped flow path therethrough characterized by the absence of discontinuities in the flow path;

(v) means for introducing a gas directly into the bottom portion of said vertical conduit at a point above the bottom end of said vertical conduit and upstream from where the vertical conduit communicates with said horizontal conduit;

(vi) means for controlling the flow rate of the gas introduced into said vertical conduit;

(vii) said vertical and horizontal conduits providing said continuous, unrestricted L-shaped flow path further characterized as having dimensions sufficient to prevent said solid coal particles from flowing from the vertical conduit in the absence of the introduction of said gas into said vertical conduit by causing said particles to assume an angle of repose on said horizontal conduit; and (viii) means for separately introducing a second gas stream directly into the top portion only of said unrestricted horizontal conduit to minimize agglomeration of said coal particles therein by removing said particles from said horizontal conduit when said angle of repose is formed, said introduction means being positioned upstream of the discharge end of the horizontal conduit.

2. An apparatus according to claim 1 wherein said means for introducing gas directly into said horizontal conduit is positioned on the end of the horizontal conduit opposite the discharge end of the horizontal conduit.

3. An apparatus according to claim 1 which includes an elbow positioned between the horizontal and vertical conduits to provide communication between said conduits.

4. An apparatus according to claim 1 wherein said means for separately introducing said second gas stream is positioned upstream of the discharge end of the horizontal conduit, but downstream of said bottom end of said vertical conduit.

* * * * *